United States Patent [19]

Kuhn

[11] 4,324,376

[45] Apr. 13, 1982

[54] RAILROAD HIGHWAY CROSSING WARNING SYSTEM

[75] Inventor: John J. Kuhn, Allison Park, Pa.

[73] Assignee: American Standard Inc., Swissvale, Pa.

[21] Appl. No.: 162,471

[22] Filed: Jun. 24, 1980

[51] Int. Cl.[3] ..... B61L 1/02

[52] U.S. Cl. ..... 246/125; 246/28 C; 246/34 R; 246/34 A; 246/34 CT; 246/121; 246/128

[58] Field of Search ..... 246/122 R, 125, 128, 246/34 R, 34 A, 34 CT, 34 C, 130, 28 C, 120, 121, 293

[56] References Cited

U.S. PATENT DOCUMENTS

| | | | |
|---|---|---|---|
| 3,246,143 | 4/1966 | Steele et al. | 246/130 R |
| 3,333,096 | 7/1967 | Ohman et al. | 246/34 |
| 3,610,920 | 10/1971 | Frielinghaus | 246/128 |
| 3,696,243 | 10/1972 | Risely | 246/121 |
| 3,781,542 | 12/1973 | Brockman | 246/125 |
| 3,977,634 | 8/1976 | Smith | 246/128 |
| 3,987,989 | 10/1976 | Geiger | 246/34 R |

*Primary Examiner*—James J. Groody
*Attorney, Agent, or Firm*—J. B. Sotak

[57] ABSTRACT

A railroad highway crossing warning system including pickup coils for sensing current flowing in the track rails of an approach zone, a circuit for sensing the voltage across the track rails, band-pass filter circuits for filtering the voltage and current derived from the track rails, impedance calculator circuits for calculating the track impedance, phase detector circuits for detecting the phase angle between the voltage and current, a multiplier circuit for linearizing the track impedance by multiplying the track impedance by a function of the phase angle, a data sampler circuit for sampling the linearized track impedance at given periodic intervals, a motion detector and crossing predictor circuit for detecting the motion of a train and for predicting the time of arrival at the crossing by comparing the predicted time of arrival with an advanced warning time, and a logic gate circuit for activating the warning apparatus at the crossing when the predicted time of arrival is less than the advanced warning time.

11 Claims, 3 Drawing Figures

RAILROAD HIGHWAY CROSSING WARNING SYSTEM

FIELD OF THE INVENTION

This invention relates to a railway crossing warning system and, more particularly, to a railroad highway grade crossing signaling system for sensing train motion and predicting the time of arrival by using discrete data sampling and digital signal processing for providing a constant warning time.

BACKGROUND OF THE INVENTION

In previous railroad grade crossing protection systems, it was conventional practice to sense the motion of an approaching train by continuously monitoring the track impedance and by detecting the change in the impedance to attempt to provide a constant warning time. It will be appreciated that the reliability of the motion sensing and the accuracy of the time-of-arrival prediction are dependent upon the linear relationship between the track impedance and the distance to an oncoming train. However, under certain conditions, the distance that a train is from the highway crossing is not always directly proportional to the impedance which appears across the track rails. In a majority of existing continuous motion detection systems, an analog computation process is then performed to detect motion. Thus, the reflected track impedance signal is then differentiated, and the change in the impedance corresponds to the purported velocity of the approaching train. In some of the prior art motion detectors, only the velocity signal is utilized to determine movement. However, in more sophisticated motion detection systems, the distance and velocity signals are combined in an endeavor to predict train arrival and to provide a constant warning time. It has been found that these prior motion detectors were possessed of several shortcomings. For example, in coded cab signal territory, interference and inaccuracy occur due to the intermittent change in the track impedance which is presented to the motion sensor. That is, the motion detector is susceptible to interference from coded track circuits due to the alternate loading and unloading of the track by the code transmitter. Thus, it will be appreciated that continuous analog computation which is presently employed in existing motion monitors is difficult to accurately achieve even under constant velocity conditions. Even in more sophisticated constant warning predictors, the time of arrival of the train at the crossing is only possible when the oncoming train is moving at a constant velocity. However, there is a long felt need of sensing the motion and of providing a constant warning time in crossing areas where the trains accelerate, decelerate, or even stop in the approach zones. While there have been previous attempts to satisfactorily accomplish such operation with existing techniques, the end result was found to be extremely complex and prohibitively expensive. Thus, there is a genuine exigency to develop a viable motion detector and time-of-arrival predictor which provides a constant warning time in crossing areas where trains accelerate, decelerate, stop, and start in the approach zones.

OBJECTS OF THE INVENTION

Accordingly, it is an object of the present invention to provide a new and improved motion sensing and constant warning system for railway crossing installations.

A further object of this invention is to provide a unique railroad highway crossing warning system.

Another object of this invention is to provide a novel grade crossing train motion detection and arrival prediction system which utilizes discrete data sampling and digital signal processing.

Yet a further object of this invention is to provide a railroad highway crossing motion detector and time-of-arrival predictor which exhibits immunity to interference to coded signals in the track rails.

Yet another object of this invention is to provide an improved motion monitor and time-of-arrival predictor for railroad crossing areas in which trains accelerate, decelerate, stop, and start in the approach zones.

Still another object of this invention is to provide a railroad highway crossing warning system comprising means for sensing current flowing in the track rails of an approach zone, means for sensing the voltage across the track rails, means for filtering the voltage and current derived from the track rails, means for calculating the track impedance, means for detecting the phase angle between the voltage and current, means for linearizing the track impedance by multiplying the track impedance by a function of the phase angle, means for sampling the linearized track impedance at given periodic intervals, means for detecting the motion of a train and for predicting the time of arrival at the crossing by comparing the predicted time of arrival with an advanced warning time, and means for activating the warning apparatus at the crossing when the predicted time of arrival is less than the advanced warning time.

Still a further object of this invention is to provide a train detector and predictor which is simple in design, economical in cost, durable in use, reliable in service, and efficient in operation.

SUMMARY OF THE INVENTION

In accordance with the invention, the present railroad highway grade crossing warning system provides a constant warning time by sensing train motion and predicting the time of arrival by using discrete data sampling and digital signal processing. The track circuit is center-fed with voltage signals which are generated by an a.c. transmitter. A first pickup coil is disposed on one side of the highway crossing adjacent the track rail to sense the amount of current flowing in a first approach zone. A second pickup coil is disposed on the other side of the highway crossing adjacent the track rail to sense the amount of current flowing in a second approach zone. A first band-pass filter circuit is connected to the first pickup coil, and a second band-pass filter circuit is connected to the second pickup coil. The first band-pass filter circuit is connected to the input of a first impedance calculator and a first phase detector while the second band-pass filter circuit is connected to input of a second impedance calculator and a second phase detector. The voltage signals across the track circuit are fed to a third band-pass filter circuit which is connected to the input of the first and second impedance calculators for producing an output signal proportional to the track impedances in the respective approach zones. The voltage signals passed by the third band-pass filter circuit are also fed to the input of the first and second phase detectors which produce an output signal proportional to the phase shift between the current and voltage in the respective approach zones.

The third band-pass filter circuit is also connected to a code detector which supplies any enabling signal to a data samping circuit to cause discrete data sampling and digital signal processing at predetermined time intervals. The sampled data is fed to a motion detector and crossing predictor circuit which calculates the distance, velocity, and acceleration of a train in the respective approach zones. In the absence of a train, the motion detector and crossing predictor supplies one input to a threeinput AND gate circuit which has its other two inputs furnished by a first and second level detector that is connected to the first and second band-pass filters, respectively. Thus, the AND gate energizes a vital relay which maintains the warning apparatus deactivated so long as no train is approaching the highway crossing. When a train enters either approach zone, the change in impedance is continuously sampled and the time of arrival at the crossing is repeatedly calculated and compared to the desired advance warning time. Now when predicted time is less than the desired time, the AND gate deenergizes the vital relay which causes the warning apparatus to be energized to forewarn pedestrians and motorists of the oncoming train.

BRIEF DESCRIPTION OF THE DRAWINGS

The above objects and other attendant features and advantages of the present invention will become more readily apparent from the following detailed description when read in conjunction with the accompanying drawings wherein.

Figure 1:
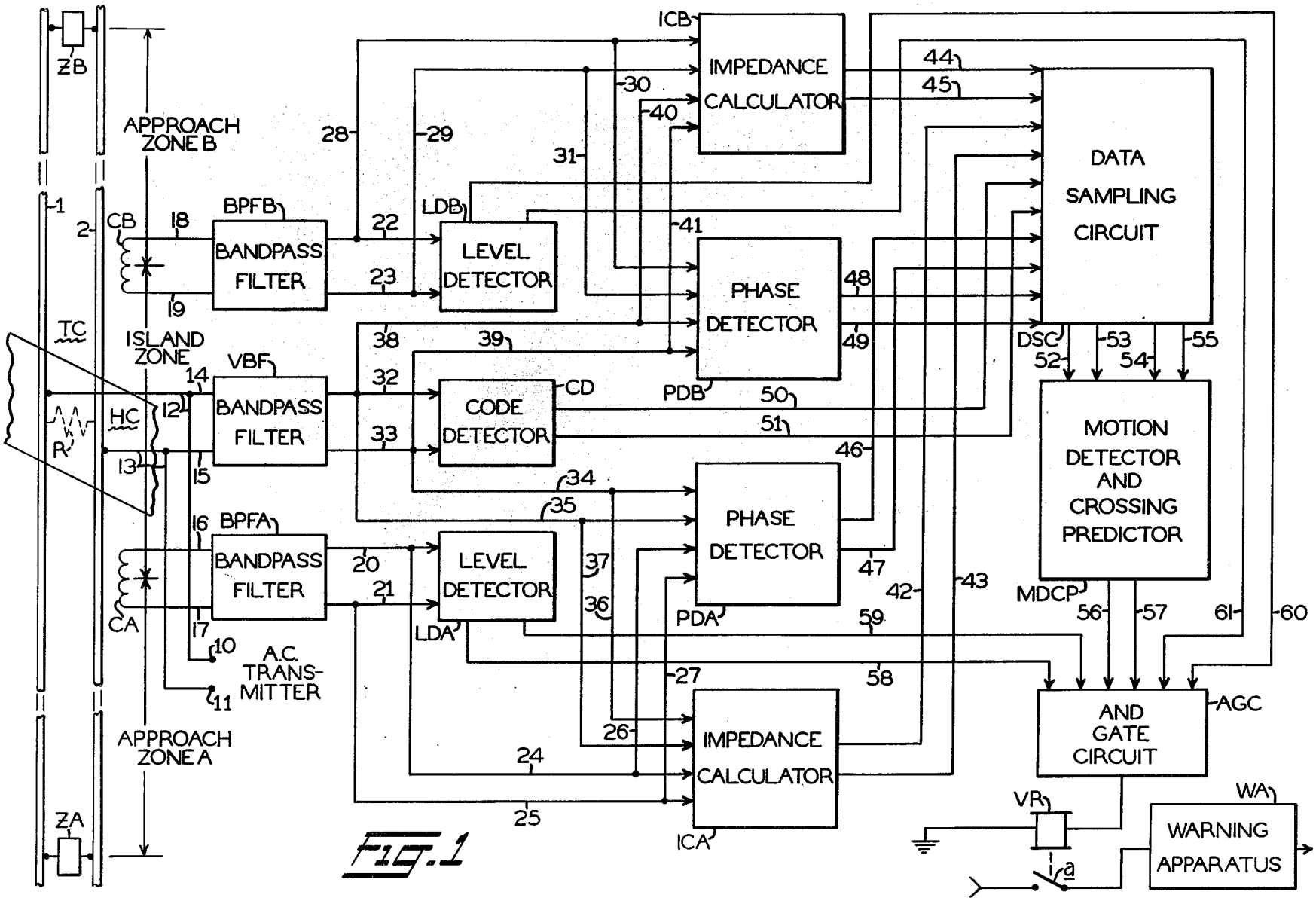
FIG. 1 is a partial block and schematic diagram of a preferred embodiment of the invention installed in association with a railroad track section which has bidirectional train movement.

Referring now to the drawings, and in particular to FIG. 1, there is shown a railroad highway grade crossing warning system for alerting a forewarning the general public of oncoming trains or transit vehicles. It will be noted that a road or highway HC is intersected or crossed by a trackway TC which includes a pair of running track rails 1 and 2. In order to provide the highest degree of safety and protection to pedestrains and motorists using the highway grade crossing, it is common practice to establish long distance approach zones on either side of the crossing and to encompass the highway with an island zone. In practice, it is also highly desirable to provide a constant warning time in activating the warning devices, such as, sounding the bell, flashing the lights and/or lowering the gates, when a train or transit vehicle is within the approach zones. That is, the velocity of oncoming trains entering the approach zones may vary from a maximum to a minimum speed so that the time of arrival will fluctuate over a wide range. Thus, in order to provide sufficient warning to the general public, it is necessary to discern the speed of an oncoming train in the approach zone to accurately predict its time of arrival at the highway crossing. As mentioned above, the railroad grade crossing also includes the island zone which provides a positive protection area or section on either side of the highway crossing HC. Thus, when a train or transit vehicle is within the confines of the island zone, the warning apparatus remains activated until such time as the last vehicle exits the island zone.

As shown in FIG. 1, input signal terminals 10 and 11 are coupled to a suitable a.c. transmitter which provides voltage signals to the track rails 1 and 2 via leads or conductors 12 and 13, respectively. It will be seen that the voltage developed across the track rails is fed to an appropriate band-pass filter VBF via leads or conductors 14 and 15. The lumped ballast leakage resistance exhibited by the track circuit is illustrated by the phontom impedance element R. The lumped ballast leakage resistance effectively limits the length of the approach zones of previous track circuits due to its loading effect. The use of salt, deicers, and cinders on the roadway during winter and the buildup of mud increase the loading effectiveness of the lumped ballast leakage resistance.

As shown, a pair of pickup coils CA and CB are disposed on either side of the highway crossing HC and are situated adjacent the track rail 2. Thus, the distance between the two coils CA and CB is defined as the positive protection island zone. It will be appreciated that the positioning of the two pickup coils may be shortened for two-lane, two-way traffic or lengthened for four or multiple-lane, two-way traffic. As shown, there are approach zones on either side of the highway crossing HC to accommodate bidirectional train movement. The upper approach zone B is determined by the position of an a.c. shunt impedance ZB, and the lower approach zone A is determined by the position of an a.c. shunt impedance ZA. It will be understood that the lengths of the two approach zones may be the same or the distances may be different dependent upon the layout of each particular railroad highway crossing. In practice, the shunts ZA and ZB are directly connected between the rails 1 and 2 by being welded thereto. Each of the a.c. shunts ZA and ZB is preferably a narrow band, sharply tuned, resonant circuit which is connected to the rails 1 and 2 when used in coded signal territory. It will be appreciated that in non-signal territory, the two shunts may be suitable wide band a.c. devices, such as, capacitors.

In viewing FIG. 1, it will be noted that current sensing pickup coil CA is connected to the input of band-pass filter network BPFA via conductors or leads 16 and 17 while the current sensing pickup coil CB is connected to the input of band-pass filter network BPFB via leads 18 and 19. The output from the band-pass filter BPFA is connected by leads 20 and 21 to a suitable level detector LDA while the output from the band-pass filter BPFB is connected by leads 22 and 23 to a level detector circuit LDB. It will be noted that the current signals passed by filter circuit BPFA are also connected to the current input of an appropriate impedance calculator ICA via leads 24 and 25 and to the current input of a suitable phase detector PDA via leads 26 and 27. Likewise, it will be seen that the current signals passed by filter circuit BPFB is also connected to the current input of an appropriate impedance calculator ICB via leads 28 and 29 and also to the current input of a suitable phase detector PDB via leads 30 and 31.

As previously mentioned, the magnitude of the voltage developed across track rails 1 and 2 is sensed and is fed to the input of band-pass filter VBF via leads 14 and 15. It will be seen that the output of filter circuit VBF is connected by leads 32 and 33 to an appropriate code detector CD which will be described in greater detail hereinafter. As shown, the output from the filter circuit VBF is also connected to the phase detector PDA via leads 34 and 35 and to the impedance calculator ICA via leads 36 and 37. Likewise, the voltage output signals from filter circuit VBF are connected to the phase detector PDB via leads 38 and 39 and to the impedance calculator ICB via leads 40 and 41. It will be observed that the output of the impedance calculator ICA is connected to the input of a suitable data sampling circuit DSC via leads 42 and 43 while the output of the impedance calculator ICB is also connected to the sampling circuit DSC via leads 44 and 45. The output of the phase detector PDA is connected to the input of the sampling circuit DSC via leads 46 and 47 while the output of the phase detector PDB is connected to the input of the sampling circuit DSC via leads 48 and 49.

It will be appreciated that the output signals of the impedance calculators ICA and ICB take the form of d.c. voltages which are proportional to the track voltage developed across the rails divided by the rail current flowing in the respective approach zone, and thus the track impedance, Z+E/I. The outputs of the phase detectors PDA and PDB are representative of the relative phase shifts between the track voltage and the rail current in the respective approach zone, namely, the phase angle $\phi$.

Figure 2:
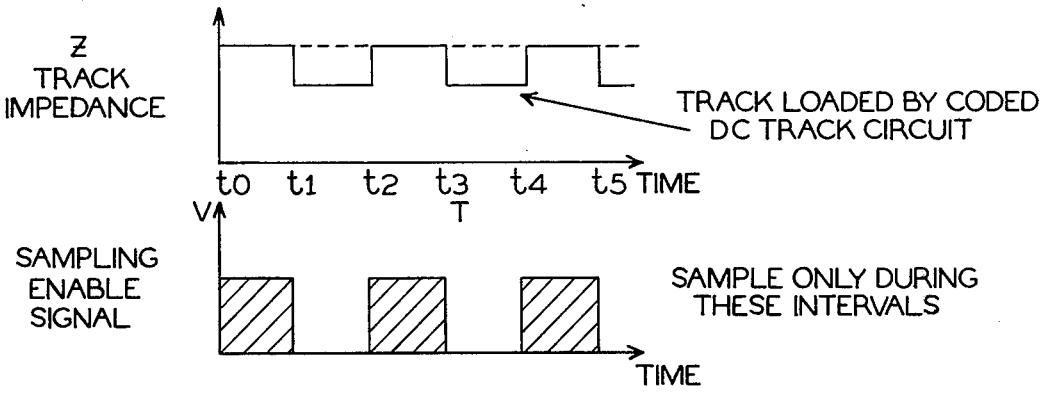
FIG. 2 are waveform diagrams of the track impedance as a function of the coded signals and of the sampling intervals for sensing the track impedance.
Figure 3:
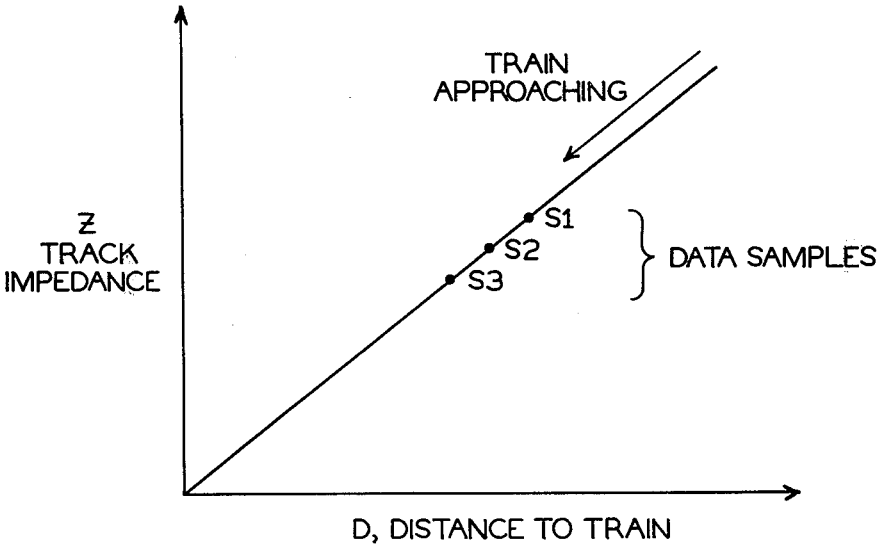
FIG. 3 is a graph of the linearized track impedance versus the distance to a train.

As mentioned above, the track is susceptible to interference or noise due to the loading and unloading in coded signal territory, and therefore, it has been found advantageous to discretely sample the impedance and phase angle data at predetermined intervals. In viewing FIG. 2, it will be noted that the upper waveform represents the track loading effect of the coded signals in the track rails 1 and 2. It will be seen that during time intervals $t_0$–$t_1$, $t_2$–$t_3$, and $t_4$–$t_5$, the true or unloaded track impedance is exhibited by the track circuit TC, and that during the time intervals $t_1$–$t_2$ and $t_3$–$t_4$, the untrue or loaded track impedance is exhibited by the track circuit TC. That is, during space portion of the coded signals, namely, during the OFF period of the code transmitter, the track circuit reflects its true value. Conversely, during the mark portion or ON period of the coded signals, the track circuit exhibits an erroneous value. Thus, in order to accurately predict the distance to a train, it is essential to measure the track impedance during the space or OFF periods of the coded signals. This is accomplished by the coded detector CD which provides the enabling pulse signals, as shown by the lower waveform in FIG. 2 to the data sampling circuit DSC at the appropriate times. It will be noted that the output of code detector CD is connected to the input of data sampling circuit DSC via leads 50 and 51. Thus, the track impedance is sampled at points S1, S2, and S3 on the linearized curve of FIG. 3 to determine distance to a train. It will be seen from FIG. 1, the discretely sampled data is fed to the motion detector and crossing predictor MDCP via leads 52, 53, 54, and 55. It will be appreciated that the method of calculating the distance, velocity, and acceleration from the sampled data, and the utilization of this information in the present constant warning time apparatus is based on the approximately linear relationship between distance to a train and the track impedance as shown in FIG. 3. Let us now consider the three data samples taken in sequence at points S1, S2, and S3 at intervals of time $\Delta t$. It will be seen that the distance D as a function of the impedance Z takes the form of:

$$D=KZ$$

where K is a constant.

Further, the velocity V of a train is:

$$V=\frac{dD}{dt}=\frac{d\,KZ}{dt}=K\frac{dZ}{dt}$$

and by using the latest data points S2 and S3, $$V\simeq K\frac{\Delta Z}{\Delta t}=\frac{K}{\Delta t}(S2-S3).$$

The acceleration A is a derivative of the velocity with respect to time, $$A=(dV)/(dt)$$

which can be approximated by, $A\simeq(\Delta V)/(\Delta t)$ where the velocity is based on two measured sets of data S1−S2 and S2−S3. Thus, the resulting velocities are, $$V_1=\frac{K}{\Delta t}(S1-S2)$$

and, $$V_2=\frac{K}{\Delta t}(S2-S3).$$

Now by substituting these velocities into the acceleration equation, the following is obtained:

$$A=\frac{V_2-V_1}{\Delta t}=\frac{1}{\Delta t}\left[\frac{K}{\Delta t}(S2-S3)-\frac{K}{\Delta t}(S1-S2)\right]=\frac{K}{\Delta t^2}((2S2-S1-S3).$$

Now the time T of arrival of the train at the crossing is calculated from the following general motion equation:

$$D=VT+\tfrac{1}{2}AT^2.$$

Further, if the acceleration is reduced to zero, then, $$D=VT.$$

Now in solving the general motion equation for the arrival time T, and taking the real root, the following results:

$$T=\frac{-V+\sqrt{V^2+2AD}}{A}$$

and substituting:

$$T = \frac{\frac{K}{\Delta t}(S2 - S3) + \sqrt{\left[\frac{K}{\Delta t}(S2 - S3)\right]^2 + \frac{2K^2}{\Delta t^2} S3(2S2 - S1 - S3)}}{\frac{K}{\Delta t^2}(2S2 - S1 - S3)}$$

by combining like terms, the following is obtained:

$$T = \Delta t \frac{(S2 - S3) + \sqrt{S2^2 + 2S2S3 - S3^2 - 2S1S3}}{2S2 - S1 - S3}$$

As will be described hereinafter, the predicted time of arrival is thus calculated and is then compared to a desired advanced warning time so that when the predicted time is less than the desired time the crossing warning devices are activated. In practice, when the acceleration is relatively small, the quantities in the above equation for the time of arrival become very small so that errors may be introduced in the calculation. Therefore, it is advantageous for the acceleration to be calculated and compared to a minimum value which will be taken into consideration. In cases where the acceleration is smaller than the minimum value, then it is assumed to be zero so that the following less complex equal may be used to calculate the time of arrival:

$$T = \frac{D}{V} = \frac{KS3}{\frac{K}{\Delta t}(S2 - S3)} = \Delta t\left(\frac{S3}{S2 - S3}\right).$$

It will be appreciated that throughout the calculation, the most recent data point information is employed in order to provide the greatest accuracy.

As shown in FIG. 1, the output of the motion detecting and crossing predicting circuit MDCP is connected by leads 56 and 57 to one input of a three-input AND gate circuit AGC. It will be seen that the second input of the three-input AND gate AGC is connected to the output of level detector LDA via leads 58 and 59 while the third input of the three-input AND gate AGC is connected to output of level detector LDB via leads 60 and 61. The output from AND gate AGC is connected to a vital relay VR which includes a movable heel contact a for controlling the electrical condition of the warning apparatus WA or devices, such as, bells, lights and/or barrier gates. The vital relay VR is normally energized during the absence of a train in the approach or island zones so that contact a is opened and the warning apparatus WA is deenergized.

Turning now to FIG. 1, let us assume that the system is intact and that no failure or broken rail exists and that a train has entered the remote end of approach zone H. As the train approaches the railroad highway crossing HC, the distance D to the train, and its velocity V and acceleration A are utilized to provide a constant warning time. The track impedance and phase angle of the track signals are employed to generate the linearized track impedance curve as shown in FIG. 3. It has been found that the track impedance can be linearized by multiplying the measured impedance by a second order function derived from the phase angle. In practice, the linearized function $Z_{lin}$ will take the form of:

$$Z_{lin} = Z\left[1 + .03\left(\phi - \frac{\phi^2}{\phi_0}\right)\right]$$

where Z is the measured impedance, $\phi$ is the measured phase angle, and $\phi_0$ is the phase angle of rail.

As the train continues to approach the highway crossing HC, the impedance is repeatedly sampled at predetermined fixed intervals S1, S2, S3, etc., from the curve in FIG. 3. The distance of the train from the highway crossing is derived from the linearized curve of FIG. 3, and the predicted time of arrival at the crossing is calculated by the motion detector and crossing predictor MDCP. The predicted time of arrival is then constantly compared to the desired advance warning time. Now, when the predicted time becomes less than the desired time, the motion detector and crossing predictor removes the output signal from leads 56 and 57 so that the AND gate AGC is turned off. The turning off of the AND gate AGC causes the deenergization of the electromagnetic relay VR which results in the closure of heel contact a. The closing of the contact results in the energization of the warning apparatus WA which sounds the bells, flashes the lights, and lowers the gates to alert motorists and pedestrians that a train is approaching the highway crossing HC. Now, when the front wheels of the leading vehicle of the train enter the positive protection area, namely, the island zone, the voltage track signals from the a.c. transmitter are shunted so that little, if any, current signals are induced into pickup coils CA and CB. Thus, the level detectors LDA and LDB stop producing output signals on leads 58–59 and 60–61 so that all three inputs are removed from AND gate AGC. Thus, the warning devices will continue to be energized so long as the train occupies the island zone. Now, when the last wheels of the train pass beyond the pickup coil CB and no other train is within the confines of the detection zone sum of the inputs on leads 56–57 and 58–59 and the input on leads 60–61 cause the AND gate AGC to turn on which, in turn, causes energization of relay VR. The energization of relay VR opens heel contact a to deenergize the warning apparatus WA.

The warning system operates in a similar manner when a train enters the approach zone B from the opposite direction to effectively provide a constant warning time.

It will be appreciated that various changes, modifications, and alternations may be made by persons skilled in the art without departing from the spirit and scope of the present invention. For example, the system may be used at a highway crossing which has single directional train movement. Further, it will be appreciated that with the advent of microprocessors, the functions of the level detectors, impedance calculators, phase detectors, data sampling, motion detector and crossing predictor and gate circuit may be accomplished in a suitable programmed digital microcomputer. In addition, it is apparent that various other variations and ramifications may be made to the subject invention and, therefore, it is understood that all changes, modifications, and equivalents within the spirit and scope of the present invention are herein meant to be encompassed in the appended claims.

Having thus described the invention, what I claim as new and desire to secure by Letters Patent, is:

1. A railroad highway crossing warning system comprising, means for sensing current flowing in the track rails of an approach zone, means for sensing the voltage across the track rails, means connected to said current and voltage sensing means for filtering the voltage and current derived from the track rails, means connected to said filtering means for calculating the track impedance, means connected to said filtering means for detecting the phase angle between the voltage and current, means connected to said impedance and phase angle means for linearizing the calculated track impedance by multiplying the track impedance by a function of the phase angle, means connected to said voltage filtering means for detecting coded signals in the track rails, means connected to said linearizing and coded detecting means for sampling the linearized track impedance at given periodic intervals, means connected to said sampling means for detecting the motion of a train and for predicting the time of arrival at the crossing by comparing the predicted time of arrival at the crossing with an advance warning time, and means connected to said motion detecting and predicting means for activating the warning apparatus at the crossing when the predicted time of arrival is less than the advance warning time.

2. The railroad highway crossing system as defined in claim 1, wherein said current sensing means takes the form of a pickup coil which is disposed adjacent the track rails at a given distance from the crossing.

3. The railroad highway crossing warning system as defined in claim 1, wherein said voltage and current filtering means are band-pass filter networks.

4. The railroad highway crossing warning system as defined in claim 1, wherein said coded signal detecting means provides an enabling signal to said sampling means during the OFF period of the code.

5. The railroad highway crossing warning system as defined in claim 1, wherein said linearized track impedance is the product of the calculated track impedance and of a second order function derived from the detected phase angle.

6. The railroad highway crossing warning system as defined in claim 1, wherein said current filtering means is connected to a means for detecting the level of the current flowing in the track rails.

7. The railroad highway crossing warning system as defined in claim 1, wherein said current sensing means includes a pair of pickup coils each being disposed adjacent the track rails a given distance from the respective sides of the crossing.

8. The railroad highway crossing warning system as defined in claim 7, wherein a band-pass filter is connected to each of the pair of pickup coils.

9. The railroad highway crossing warning system as defined in claim 8, wherein a band-pass filter is connected to said voltage sensing means.

10. The railroad highway crossing warning system as defined in claim 9, wherein said band-pass filters are connected to a pair of impedance calculators and a pair of phase detectors.

11. The railroad highway crossing warning system as defined in claim 6, wherein said level detecting and said motion detecting and predicting means having their outputs connected to an AND gate circuit which controls the electrical condition of a vital relay.

* * * * *